US008668504B2

(12) United States Patent
Cofini

(10) Patent No.: US 8,668,504 B2
(45) Date of Patent: Mar. 11, 2014

(54) THREADLESS LIGHT BULB SOCKET

(75) Inventor: Michael Eugene Cofini, Spokane, WA (US)

(73) Assignee: Dave Smith Chevrolet Oldsmobile Pontiac Cadillac, Inc., Kellogg, ID (US)

( * ) Notice: Subject to any disclaimer, the term of this patent is extended or adjusted under 35 U.S.C. 154(b) by 49 days.

(21) Appl. No.: 13/540,318

(22) Filed: Jul. 2, 2012

(65) Prior Publication Data

US 2013/0012040 A1 Jan. 10, 2013

Related U.S. Application Data

(60) Provisional application No. 61/571,765, filed on Jul. 5, 2011.

(51) Int. Cl.
*H01R 13/648* (2006.01)

(52) U.S. Cl.
USPC ..... 439/101

(58) Field of Classification Search
USPC ..... 439/101–108, 188, 642
See application file for complete search history.

(56) References Cited

U.S. PATENT DOCUMENTS

| | | | | |
|---|---|---|---|---|
| 656,284 | A | | 8/1900 | Froschl |
| 1,104,577 | A | | 7/1914 | Thomas |
| 1,187,301 | A | | 6/1916 | Goodridge |
| 1,262,936 | A | | 4/1918 | Fowler |
| 1,632,599 | A | | 6/1927 | Hayward |
| 1,640,189 | A | | 8/1927 | Hamiel |
| 1,702,135 | A | | 2/1929 | Sawers et al. |
| 1,721,365 | A | | 7/1929 | Zwetsch |
| 1,810,901 | A | | 6/1931 | Bormann et al. |
| 1,818,380 | A | | 8/1931 | Cartier |
| 2,025,564 | A | | 12/1935 | Blake |
| 2,056,502 | A | | 10/1936 | Borell |
| 2,071,769 | A | | 2/1937 | Schlicker et al. |
| 2,122,848 | A | | 7/1938 | Stearns |
| 2,191,336 | A | | 2/1940 | Carrol |
| 2,209,808 | A | | 7/1940 | Bryant et al. |
| 2,283,934 | A | | 5/1942 | Jorgensen |
| 2,372,266 | A | | 3/1945 | Frank |
| 2,494,755 | A | | 1/1950 | Grover |
| 2,503,677 | A | | 4/1950 | McHenry et al. |
| 2,511,037 | A | * | 6/1950 | Bedoiseau ..... 439/459 |
| 2,565,999 | A | | 8/1951 | Teglas et al. |
| 2,636,068 | A | | 4/1953 | Perkins |
| 2,682,039 | A | | 6/1954 | Tinnerman |
| 2,738,474 | A | | 3/1956 | Stube |
| 2,741,747 | A | | 4/1956 | Woofter |
| 2,771,308 | A | | 11/1956 | Vitcha et al. |
| 2,791,679 | A | | 5/1957 | Hierholzer, Jr. et al. |
| 2,800,635 | A | * | 7/1957 | Christenbery ..... 439/419 |
| 3,046,672 | A | * | 7/1962 | Lace ..... 33/348 |
| 3,056,941 | A | | 10/1962 | Erikson |

(Continued)

*Primary Examiner* — Chandrika Prasad
(74) *Attorney, Agent, or Firm* — Wells St. John P.S.

(57) ABSTRACT

A threadless light socket assembly allows a light bulb to be changed by pushing or pulling the light bulb into or out of the socket provides an outer insulator housing and an insulator cap which carrying a ground socket in a medial channel that grounds a light bulb base to a power supply. Plural spring biased thread locks protrude into center of the ground socket and are staggered in height to align with threads defined in a light bulb base. A positive contact is in the socket assembly supplies positive power from a power supply to the light bulb base. The threadless light socket has interchangeable components to allow installation in new and existing light fixtures.

14 Claims, 13 Drawing Sheets

(56) References Cited

U.S. PATENT DOCUMENTS

| | | | | | |
|---|---|---|---|---|---|
| 3,173,473 | A | | 3/1965 | Loveland | |
| 3,403,901 | A | | 10/1968 | Servadio | |
| 3,430,184 | A | | 2/1969 | Acord | |
| 3,452,316 | A | | 6/1969 | Panek et al. | |
| 3,465,284 | A | | 9/1969 | McManus | |
| 3,484,736 | A | | 12/1969 | Wyse | |
| 3,569,903 | A | | 3/1971 | Brishka | |
| 3,569,907 | A | | 3/1971 | Landgraf | |
| 3,573,705 | A | * | 4/1971 | Magi | 439/101 |
| 3,594,681 | A | * | 7/1971 | Weiss | 439/101 |
| 3,633,023 | A | | 1/1972 | Castiglioni | |
| 3,659,329 | A | | 5/1972 | Walker | |
| 3,676,835 | A | | 7/1972 | Holly | |
| 3,678,439 | A | | 7/1972 | Vetter | |
| 3,723,944 | A | | 3/1973 | Gauchat et al. | |
| 3,793,685 | A | | 2/1974 | Knecht | |
| 3,800,267 | A | * | 3/1974 | Burgess et al. | 439/101 |
| 3,805,211 | A | * | 4/1974 | Moore | 439/101 |
| 3,895,195 | A | | 7/1975 | Morrison et al. | |
| 3,915,536 | A | | 10/1975 | Glantz | |
| 3,936,122 | A | | 2/1976 | Hagelberg | |
| 4,008,941 | A | | 2/1977 | Smith | |
| 4,017,139 | A | | 4/1977 | Nelson | |
| 4,040,714 | A | | 8/1977 | Grover et al. | |
| 4,099,820 | A | | 7/1978 | DeLano | |
| 4,100,448 | A | | 7/1978 | Chipner et al. | |
| 4,121,134 | A | | 10/1978 | Fontenelle | |
| 4,134,634 | A | | 1/1979 | Baur et al. | |
| 4,159,161 | A | | 6/1979 | Timmer | |
| 4,208,082 | A | | 6/1980 | Davies et al. | |
| 4,210,373 | A | | 7/1980 | McGee | |
| 4,222,623 | A | | 9/1980 | Hultberg | |
| 4,279,458 | A | | 7/1981 | Knapp | |
| 4,319,796 | A | | 3/1982 | Wiley | |
| 4,374,606 | A | | 2/1983 | Lathrop | |
| 4,376,564 | A | | 3/1983 | Kilbourne | |
| 4,412,717 | A | | 11/1983 | Monroe | |
| 4,456,322 | A | | 6/1984 | Ferroni | |
| 4,548,449 | A | | 10/1985 | Corsetti | |
| 4,610,496 | A | | 9/1986 | Schwartz et al. | |
| 4,632,480 | A | | 12/1986 | Carpenter | |
| 4,632,490 | A | * | 12/1986 | Von Gunten | 439/642 |
| 4,655,534 | A | | 4/1987 | Stursa | |
| 4,768,966 | A | | 9/1988 | Doherty | |
| 4,778,409 | A | | 10/1988 | Maddock | |
| 4,798,371 | A | | 1/1989 | Wallisser | |
| 4,825,393 | A | | 4/1989 | Nishiya | |
| 4,872,852 | A | | 10/1989 | Palitz, Jr. | |
| 4,883,434 | A | | 11/1989 | Toyoshima | |
| 4,902,251 | A | | 2/1990 | Grzena | |
| 4,915,667 | A | | 4/1990 | Tobias-Pader | |
| 4,940,422 | A | | 7/1990 | Forish et al. | |
| 4,941,846 | A | | 7/1990 | Guimond et al. | |
| 4,975,813 | A | | 12/1990 | Chen | |
| 5,006,751 | A | | 4/1991 | Marshall | |
| 5,024,604 | A | | 6/1991 | Savin et al. | |
| 5,030,124 | A | | 7/1991 | Lorentzon | |
| 5,059,139 | A | | 10/1991 | Spinner | |
| 5,062,808 | A | | 11/1991 | Hosler, Sr. | |
| 5,154,628 | A | | 10/1992 | Skegin | |
| 5,171,292 | A | | 12/1992 | Ortiz | |
| 5,195,906 | A | | 3/1993 | Szegda | |
| 5,278,741 | A | | 1/1994 | Ehrman | |
| 5,282,756 | A | | 2/1994 | Heindl et al. | |
| 5,316,494 | A | | 5/1994 | Flanagan et al. | |
| D347,620 | S | | 6/1994 | Henrici | |
| 5,380,214 | A | | 1/1995 | Ortega, Jr. | |
| 5,382,181 | A | | 1/1995 | Ortiz | |
| 5,447,442 | A | | 9/1995 | Swart | |
| 5,456,611 | A | | 10/1995 | Henry et al. | |
| 5,482,477 | A | | 1/1996 | Michael | |
| 5,521,460 | A | | 5/1996 | Zhu | |
| 5,547,400 | A | | 8/1996 | Wright | |
| 5,561,269 | A | | 10/1996 | Robertson et al. | |
| 5,573,419 | A | | 11/1996 | Chen | |
| 5,593,324 | A | | 1/1997 | Ito | |
| 5,595,493 | A | * | 1/1997 | Chen | 439/188 |
| 5,595,499 | A | | 1/1997 | Zander et al. | |
| 5,595,513 | A | | 1/1997 | Kondo | |
| 5,632,643 | A | | 5/1997 | Shepherd et al. | |
| 5,634,812 | A | * | 6/1997 | Chen | 439/419 |
| 5,681,186 | A | | 10/1997 | Wright | |
| 5,695,357 | A | | 12/1997 | Wright | |
| 5,700,154 | A | | 12/1997 | Geary | |
| 5,707,246 | A | | 1/1998 | Perkins | |
| 5,741,159 | A | | 4/1998 | Wright | |
| 5,743,758 | A | | 4/1998 | Cheng et al. | |
| 5,746,606 | A | | 5/1998 | Sobhani | |
| 5,800,212 | A | | 9/1998 | Hsu | |
| 5,842,872 | A | | 12/1998 | Hosler, Sr. et al. | |
| 5,897,391 | A | | 4/1999 | Takahashi et al. | |
| 5,989,070 | A | | 11/1999 | Al-Turki | |
| 6,033,248 | A | | 3/2000 | Lyons | |
| 6,036,540 | A | | 3/2000 | Beloritsky | |
| 6,163,264 | A | | 12/2000 | Birch et al. | |
| 6,224,410 | B1 | | 5/2001 | Chen | |
| 6,241,261 | B1 | | 6/2001 | Rehm | |
| 6,267,612 | B1 | | 7/2001 | Arcykiewicz et al. | |
| 6,322,380 | B1 | | 11/2001 | Conroy | |
| 6,393,684 | B2 | | 5/2002 | Masuda et al. | |
| 6,398,592 | B1 | | 6/2002 | Mori et al. | |
| 6,406,333 | B2 | | 6/2002 | Harris | |
| 6,491,534 | B1 | | 12/2002 | Bonard et al. | |
| 6,619,876 | B2 | | 9/2003 | Vaitkus et al. | |
| 6,652,305 | B1 | | 11/2003 | DiFusco | |
| 6,676,445 | B2 | | 1/2004 | Hal et al. | |
| 6,679,647 | B2 | | 1/2004 | Hixon | |
| 6,682,303 | B2 | | 1/2004 | Wu | |
| 6,692,285 | B2 | | 2/2004 | Islam | |
| 6,692,286 | B1 | | 2/2004 | De Cet | |
| 6,695,636 | B2 | | 2/2004 | Hall et al. | |
| 6,705,886 | B1 | | 3/2004 | Brown | |
| 6,713,948 | B2 | | 3/2004 | Meinecke | |
| 6,761,469 | B2 | | 7/2004 | Wu | |
| 6,769,926 | B1 | | 8/2004 | Montena | |
| 6,783,383 | B1 | | 8/2004 | Gibboney | |
| 6,799,869 | B1 | | 10/2004 | Beadle | |
| 6,811,424 | B2 | | 11/2004 | Seminara et al. | |
| 6,848,931 | B2 | | 2/2005 | McMullen et al. | |
| 6,857,892 | B2 | | 2/2005 | McLauchlan et al. | |
| 6,860,761 | B2 | | 3/2005 | Lee et al. | |
| 6,921,279 | B2 | | 7/2005 | Sian et al. | |
| 6,932,620 | B2 | | 8/2005 | Ishiguro et al. | |
| 6,945,801 | B2 | | 9/2005 | Brown | |
| 6,948,833 | B2 | | 9/2005 | Wu | |
| 6,964,579 | B2 | | 11/2005 | Seminara et al. | |
| 7,055,864 | B2 | | 6/2006 | Pelfrey et al. | |
| 7,101,229 | B2 | | 9/2006 | Tufano et al. | |
| 7,105,744 | B1 | | 9/2006 | Kwong et al. | |
| 7,121,891 | B2 | | 10/2006 | Cherian | |
| 7,150,648 | B1 | | 12/2006 | Hall et al. | |
| 7,160,149 | B1 | | 1/2007 | Chawgo | |
| 7,163,333 | B2 | | 1/2007 | Lin | |
| 7,165,982 | B2 | | 1/2007 | Hafele et al. | |
| 7,175,466 | B2 | | 2/2007 | Feinweber et al. | |
| 7,189,113 | B2 | | 3/2007 | Sattele et al. | |
| 7,226,202 | B2 | | 6/2007 | Chen | |
| 7,229,303 | B2 | | 6/2007 | Vermoesen et al. | |
| 7,234,973 | B1 | | 6/2007 | Shelly | |
| 7,238,047 | B2 | | 7/2007 | Saettele et al. | |
| 7,244,148 | B2 | | 7/2007 | Maguire et al. | |
| 7,264,496 | B2 | | 9/2007 | Wu | |
| 7,288,002 | B2 | | 10/2007 | Rodrigues et al. | |
| 7,294,006 | B1 | | 11/2007 | Chen | |
| 7,309,255 | B2 | | 12/2007 | Rodrigues | |
| 7,347,726 | B2 | | 3/2008 | Wlos | |
| 7,347,727 | B2 | | 3/2008 | Wlos et al. | |
| 7,364,450 | B2 | | 4/2008 | Hafner et al. | |
| 7,387,409 | B1 | | 6/2008 | Beadle | |
| 7,387,522 | B2 | | 6/2008 | Janos et al. | |
| 7,413,456 | B1 | | 8/2008 | Di Fusco | |
| 7,419,403 | B1 | | 9/2008 | Paynter | |
| 7,455,550 | B1 | | 11/2008 | Sykes | |
| 7,456,357 | B1 | | 11/2008 | Kwong et al. | |

(56) References Cited

U.S. PATENT DOCUMENTS

| | | | |
|---|---|---|---|
| 7,462,052 | B2 | 12/2008 | Karton |
| D586,299 | S | 2/2009 | Suzuki et al. |
| 7,484,988 | B2 | 2/2009 | Ma et al. |
| 7,494,262 | B2 | 2/2009 | Runions et al. |
| 7,513,795 | B1 | 4/2009 | Shaw |
| 7,513,802 | B2 | 4/2009 | Tufano, Sr. et al. |
| 7,530,850 | B2 | 5/2009 | Maguire et al. |
| 7,549,786 | B2 | 6/2009 | Higley et al. |
| 7,566,243 | B1 | 7/2009 | Hung |
| 7,568,934 | B1 | 8/2009 | Williams et al. |
| 7,575,459 | B2 | 8/2009 | Nickol |
| D601,966 | S | 10/2009 | Shaw |
| D601,967 | S | 10/2009 | Shaw |
| 7,597,588 | B1 | 10/2009 | Hyzin et al. |
| 7,618,288 | B1 | 11/2009 | Di Fusco |
| D607,826 | S | 1/2010 | Shaw |
| D607,827 | S | 1/2010 | Shaw |
| D607,828 | S | 1/2010 | Shaw |
| D607,829 | S | 1/2010 | Shaw |
| D607,830 | S | 1/2010 | Shaw |
| D608,294 | S | 1/2010 | Shaw |
| 7,695,292 | B2 | 4/2010 | Lee |
| 7,727,011 | B2 | 6/2010 | Montena et al. |
| 7,758,370 | B1 | 7/2010 | Flaherty |
| 7,762,856 | B2 | 7/2010 | Friesen et al. |
| 7,786,379 | B1 | 8/2010 | Kwong et al. |
| 7,798,838 | B2 | 9/2010 | Grieff et al. |
| 7,806,714 | B2 | 10/2010 | Williams et al. |
| 7,841,896 | B2 | 11/2010 | Shaw et al. |
| 7,850,472 | B2 | 12/2010 | Friedrich et al. |
| 7,854,621 | B2 | 12/2010 | Poulsen |
| 7,867,018 | B2 | 1/2011 | Krieg et al. |
| 7,892,004 | B2 | 2/2011 | Hertzler et al. |
| 7,905,738 | B2 | 3/2011 | Donetsky |
| 7,914,347 | B2 | 3/2011 | Paulus |
| 7,938,570 | B2 | 5/2011 | Lee et al. |
| 7,938,654 | B2 | 5/2011 | Stein |
| 7,959,419 | B2 | 6/2011 | Borowski et al. |
| 7,972,158 | B2 | 7/2011 | Wild et al. |
| 7,972,173 | B1 | 7/2011 | Hyzin et al. |
| 8,033,858 | B1 | 10/2011 | Chen |
| 8,105,119 | B2 | 1/2012 | Swart et al. |
| 8,146,225 | B2 | 4/2012 | Olinger et al. |
| 8,167,637 | B1 | 5/2012 | Projkovski |
| 8,187,015 | B2 | 5/2012 | Boyd et al. |
| 8,206,175 | B2 | 6/2012 | Boyd et al. |
| 8,221,161 | B2 | 7/2012 | Leibfried, Jr. |
| 8,235,741 | B2 | 8/2012 | Schulze et al. |
| 8,241,060 | B2 | 8/2012 | Sykes |

* cited by examiner

THREADLESS LIGHT BULB SOCKET

RELATED APPLICATIONS

This application claims the benefit of earlier filed U.S. Provisional Patent Application No. 61/571,765 titled THREADLESS LIGHT BULB SOCKET filed on Jul. 5, 2011. By this reference, the entire contents of the aforementioned the Provisional patent application is incorporated herein.

BACKGROUND OF INVENTION

1. Field of the Invention

The present invention relates generally to light bulb sockets, and more specifically to a threadless light bulb socket allowing installation and removal of a common threaded light bulb by pushing or pulling the light bulb in or out of the light socket without a need to axially rotate the light bulb or the socket.

2. Background of the Invention and Description of the Prior Art

Light Bulb Sockets for receiving and powering threaded screw-in light bulbs are known. The purpose and object of a light bulb socket is to secure a light bulb into a light fixture and to conduct electric current through a positive terminal and a ground terminal of the bulb to cause illumination of the bulb.

Over the years, a variety of means and methods have been developed to make it easier to install/remove a threaded light bulb in/from a light socket. Some such means and methods have used a socket formed from a flexible conductive material that flexes to allow a threaded light bulb to slide into or out of the socket with sufficient resistance so the bulb will not fall out of the socket and will still conduct electricity to the bulb.

Although such sockets have made it easier to install and replace a light bulb, these sockets have remained ineffective because they cannot be altered to accommodate various types of light bulbs or light fixtures.

The many different sizes, shapes, and weights of light bulbs cannot be accommodated in known threadless sockets. For example, a large flood lamp in a ceiling light fixture requires more pressure to secure than a standard 60 watt light bulb in a table lamp. Further, when the bulb is inverted, the weight of the light bulb becomes a factor because the pressure supplied by the socket must be sufficient to securely retain the light bulb while concurrently maintaining electrical contact with the positive terminal and of the negative terminal of the bulb Maintaining a sufficient holding force on the light bulb is especially important when the fixture and bulb therein are inverted and suspended above people's heads or anything else that could be damaged if the light bulb were to fall out of socket and/or fixture.

Known threadless sockets are also larger than common light sockets, which makes it impossible for the user to install such known threadless sockets into light fixtures without the need to modify the light fixtures to accommodate a larger socket.

Another problem with known threadless sockets is the inability to change the retaining pressure exerted in a light bulb to positionally maintain the light bulb. As noted previously, known threadless sockets use plural flexible fingers formed of electrically conductive material. As such, to accommodate a different light bulb, or an entirely different weight of light bulb, a different bulb socket is needed. Unfortunately, with hundreds of different sizes, shapes, and weights of light bulbs available and in use, one would need to manufacture a threadless socket for nearly every light bulb size and weight.

My threadless light bulb socket overcomes various of the aforementioned drawbacks by providing a threadless socket that is standard socket size, can securely retain and power a wide variety of bulbs and can be modified to accommodate many different sizes and styles of light bulbs. Insulator housings are also interchangeable to install my threadless sockets in all different types and styles of light fixtures, without the need to modify the fixture.

Some or all of the drawbacks and problems explained above, and other drawbacks and problems, may be helped or solved by my invention shown and described herein. My invention may also be used to address other problems not set out herein or which become apparent at a later time. The future may also bring to light unknown benefits which may be in the future appreciated from the novel invention shown and described herein.

My invention does not reside in any one of the identified features individually, but rather in the synergistic combination of all of its structures, which give rise to the functions necessarily flowing therefrom as hereinafter specified and claimed.

SUMMARY OF THE INVENTION

My threadless light socket provides an insulator housing axially carrying a ground socket, defining plural spacedly arranged radial holes carrying thread locks and biasing springs for holding and grounding a light bulb in the socket. An insulation cap secures the ground socket in the insulation housing and carries a positive terminal contact for electrical contact with the light bulb. A socket retainer positionally maintains the socket in a light fixture.

In providing such a threadless light socket assembly:

- a principal object to provide a threadless light socket assembly that allows a threaded light bulb to be installed into and removed from the socket, without axially rotating the socket or the light bulb.
- a further object to provide such an assembly that allows a light bulb to be removed from the socket by axially pulling the light bulb out of the socket and to be installed into the socket by axially pushing the light bulb into the socket.
- a further object to provide such an assembly which can be modified for receiving and retaining standard screw-in light bulbs of various sizes, shapes, weights and types.
- a further object to provide such an assembly that can be installed in a variety of light fixtures.
- a further object to provide such an assembly that may be used to retro-fit old light fixtures.
- a further object to provide such an assembly that may be installed in vertical, horizontal, overhead, and recessed light fixtures.
- a further object to provide such an assembly that maintains continuous electrical contact with the light bulb positive terminal and ground terminal.
- a further object to provide such an assembly that may be modified to change the amount of force that positionally retains the light bulb in the socket, and the amount of force it takes to install and remove the light bulb.
- a further object to provide such an assembly that uses thread locks, applying a radial inward force to a light bulb's threaded base to secure the bulb in the socket and to provide a ground contact.

a further object to provide such an assembly wherein the pressure supplied by the thread locks may be easily changed by changing the biasing springs.

a further object to provide such an assembly wherein the thread lock housings defined in the ground socket are staggered in position so the thread locks engage in the deepest concave position of the bulb base threads.

a further object to provide such an assembly that ensures that the light bulb is held securely and safely in the socket.

a further object to provide such an assembly that has interchangeable insulator housings so the socket can be adapted into different styles and types of light fixtures, including recessed ceiling light fixtures, horizontal fixtures and table and floor lamps.

a further object to provide such an assembly that is adaptable to different applications and/or building codes without the need to manufacture a completely different socket.

a further object to provide such an assembly that complies with federal, state and local electrical and building codes and regulations.

a further object to provide such an assembly having interchangeable components.

a further object to provide such an assembly wherein the ground socket may be manufactured from a variety of conductive materials.

a further object to provide such an assembly that may be disassembled and reassembled with minimal tools and apparatus.

a further object to provide such an assembly that makes it easier to change a light bulb, even in recessed light fixtures in high ceilings.

Other and further objects of my invention will appear from the following specification and accompanying drawings which form a part hereof. In carrying out the objects of my invention it is to be understood that its structures and features and steps are susceptible to change in design and arrangement and order with only one preferred and practical embodiment of the best known mode being illustrated in the accompanying drawings and specified as is required.

BRIEF DESCRIPTION OF THE DRAWINGS

Specific forms, configurations, embodiments and/or diagrams relating to and helping to describe preferred versions of my invention are explained and characterized herein, often with reference to the accompanying drawings. The drawings and all features shown therein also serve as part of the disclosure of my invention, whether described in text or merely by graphical disclosure alone. Such drawings are briefly described below.

DESCRIPTION OF PREFERRED EMBODIMENT

The readers of this document should understand that the embodiments described herein may rely on terminology used in any section of this document and other terms readily apparent from the drawings and the language common therefore as may be known in a particular art and such as known or indicated and provided by dictionaries. Dictionaries were used in the preparation of this document. Widely known and used in the preparation hereof are *Webster's Third New International Dictionary* (©1993), *The Oxford English Dictionary* (Second Edition, ©1989), *The New Century Dictionary* (©2001-2005) and the *American Heritage Dictionary of the English Language* ($4^{th}$ Edition©2000) all of which are hereby incorporated by reference for interpretation of terms used herein and for application and use of words defined in such references to more adequately or aptly describe various features, aspects and concepts shown or otherwise described herein using more appropriate words having meanings applicable to such features, aspects and concepts.

This document is premised upon using one or more terms or features shown in one embodiment that may also apply to or be combined with other embodiments for similar structures, functions, features and aspects of the invention and provides additional embodiments of the invention. Wording used in the claims is also descriptive of the invention and the text of both claims and abstract are incorporated by reference into the description entirely. Terminology used with one, some or all embodiments may be used for describing and defining the technology and exclusive rights associated herewith.

The readers of this document should further understand that the embodiments described herein may rely on terminology and features used in any section or embodiment shown in this document and other terms readily apparent from the drawings and language common or proper therefore.

Figure 1:
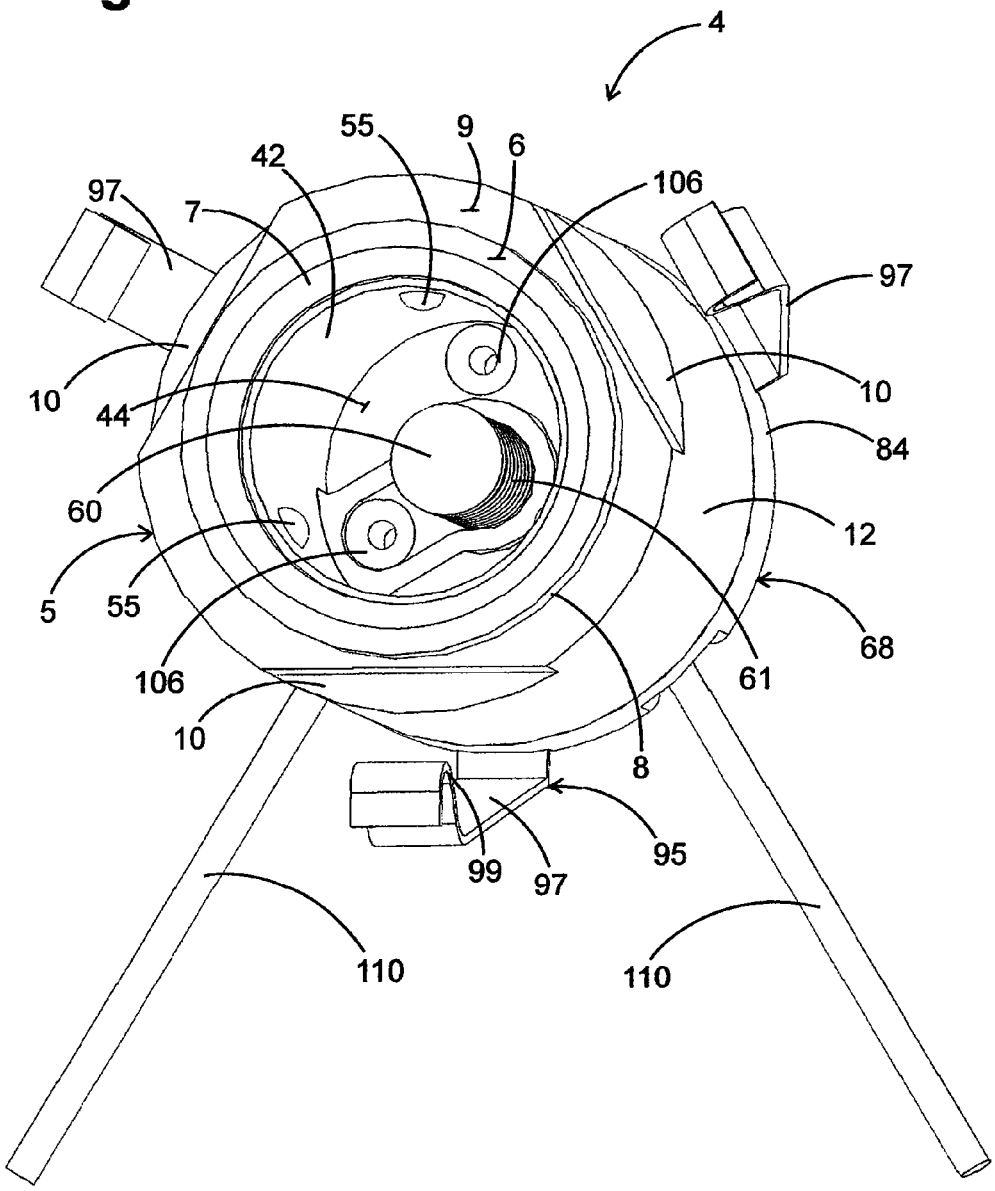
FIG. 1 is an isometric top and side view of my threadless light socket assembly.
Figure 2:
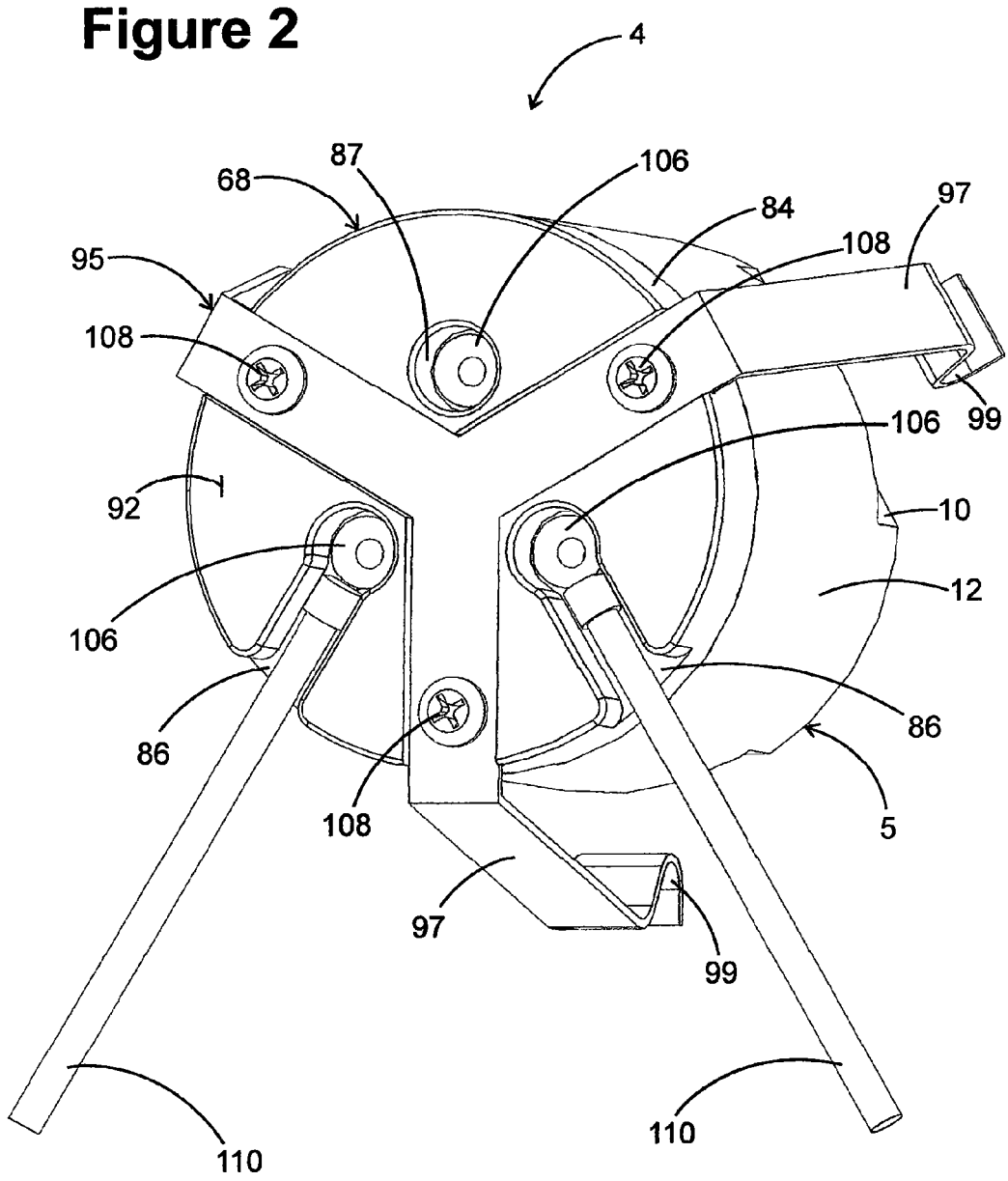
FIG. 2 is an isometric bottom, and side view of the threadless light socket assembly of FIG. 1.
Figure 3:
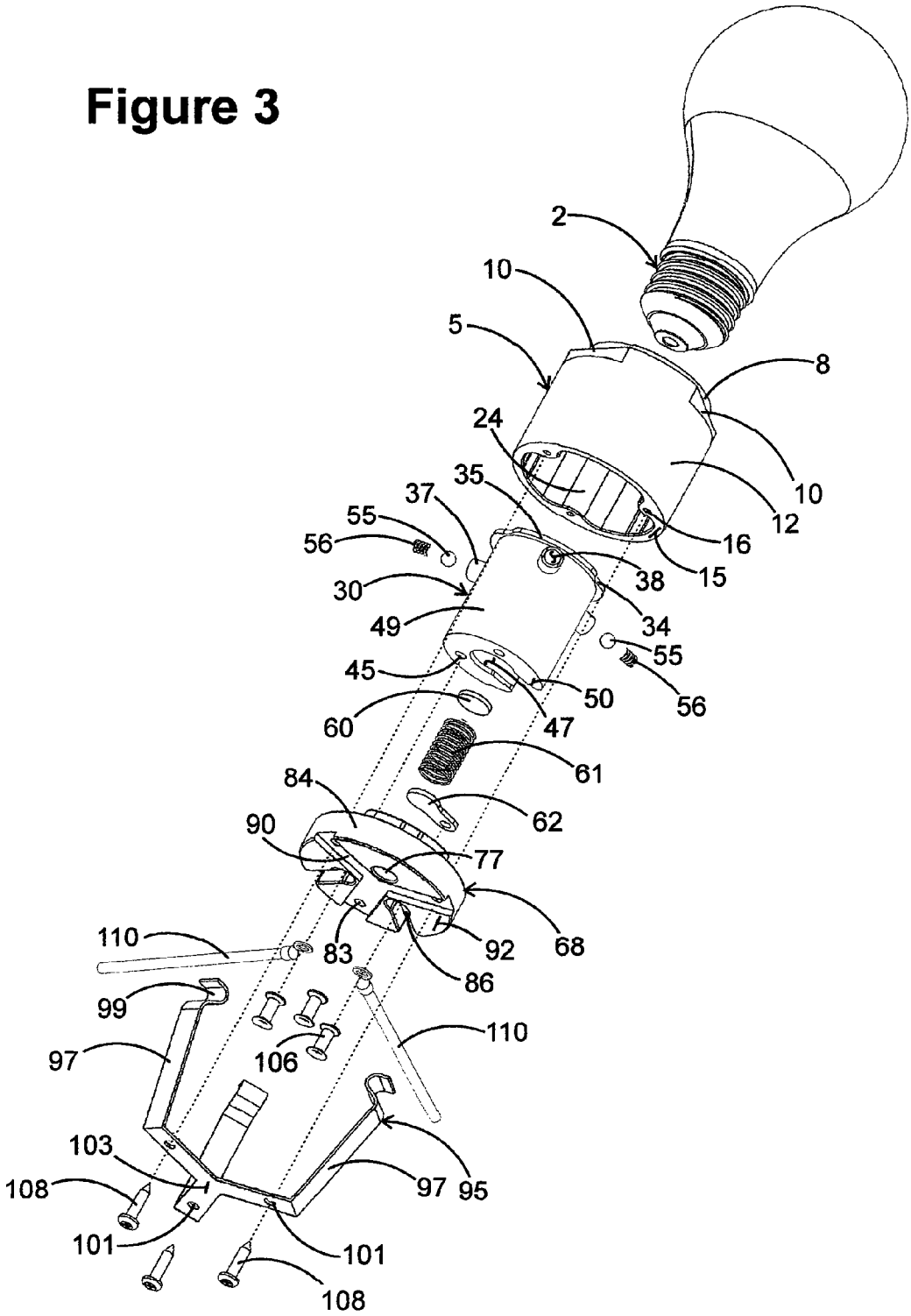
FIG. 3 is an exploded isometric side and bottom view of the threadless light socket assembly of FIG. 1, showing how the various parts fit together.
Figure 4:
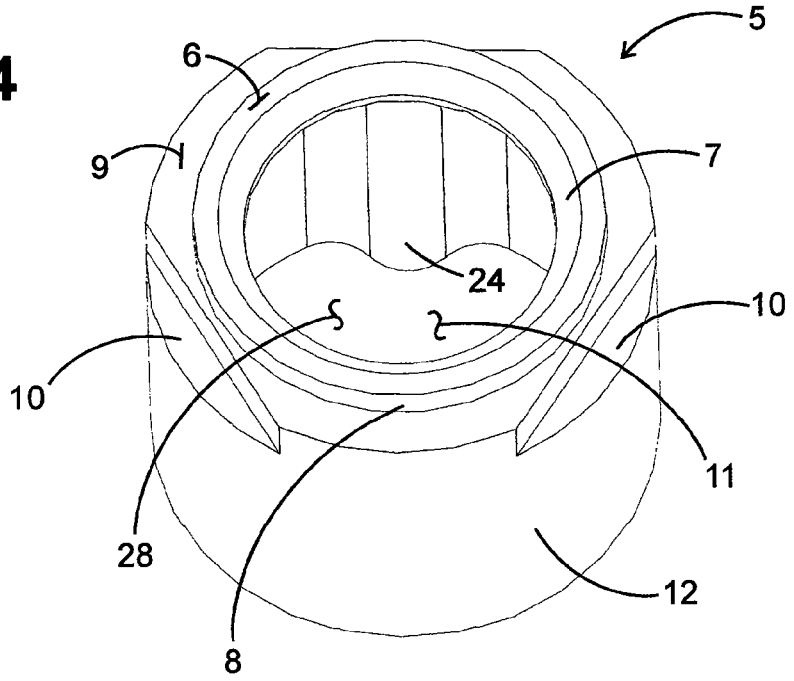
FIG. 4 is an isometric top and side view of the insulator housing.

My threadless light socket assembly 4 generally provides an insulator housing 5, a ground socket 30, an insulator cap 68 and a socket retainer 95 and is designed to work with and install into a variety of lighting fixtures. The insulator housing 5 is formed of a non-conductive material, such as, but not limited to, polycarbonate, Plexiglas®, Lexan®, glass, ceramic, acrylic or plastic. The insulator housing 5 has a top 6 which has a beveled edge 7 around a top opening 11. The beveled edge 7 helps align screw-in light bulbs with the top opening 11. A mounting flange 8 and a mounting surface 9 are also defined on the top 6 to assist in seating and aligning the assembly 4 in a recessed lighting fixture (not shown). Retainer reliefs 10 defined in the mounting surface 9 provide clearance for retainer locks 99 (FIG. 3), carried by socket retainer 95. Retainer locks 99 of the socket retainer 95 slide over outer circumferential surface 12 of the insulator housing 5. Bottom 15 of insulator housing 5 defines plural mounting holes 16 for an insulator cap 68 and has a beveled edge 17 extending around bottom inside edge of the insulator housing 5.

Alignment boss 24 aligns the ground socket 30 (and a second embodiment of ground socket 31) with alignment relief 34 defined in the ground socket 30, 31. Alignment of the boss 24 and relief 34 causes spring housings 37 to align with spring seats 18 which responsively aligns biasing springs 56 so a first end of each biasing spring 56 seats against spring seat 18. Opposing end of each biasing spring 18 seats against and applies pressure against thread locks 55.

Figure 5:
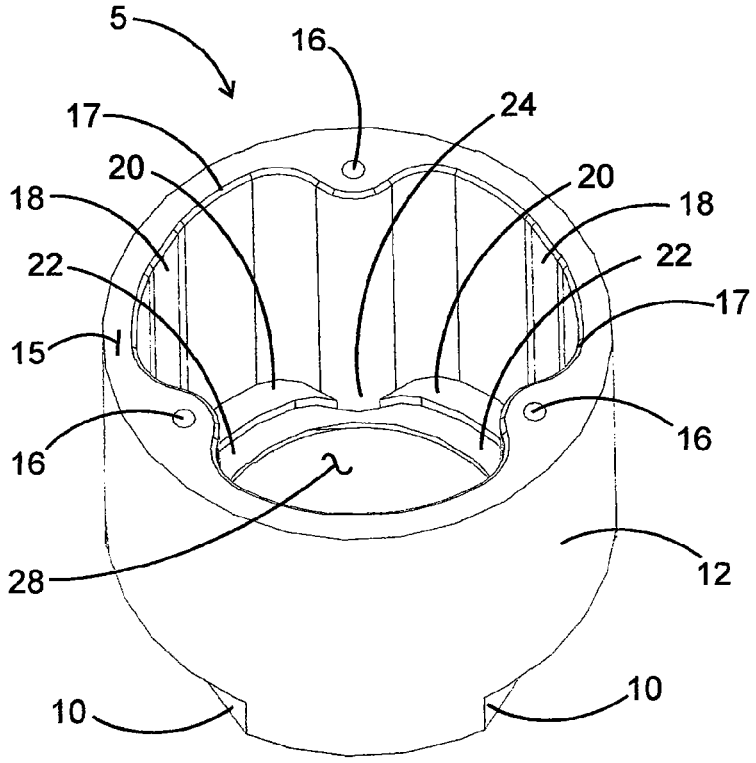
FIG. 5 is an isometric bottom and side view of the insulator housing of FIG. 4.
Figure 9:
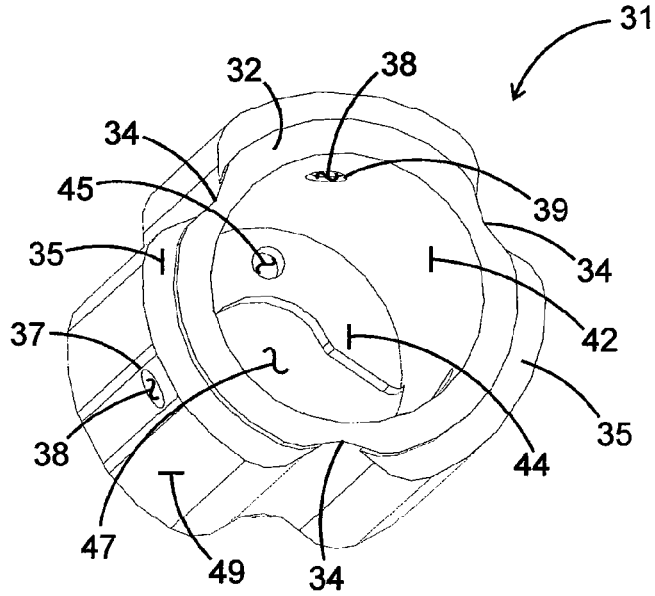
FIG. 9 is an isometric top and side view of a second embodiment of the ground socket.

FIG. 9 shows top 32 and flange surface 35 of a second embodiment of the ground socket 31. The top 32 seats against an inside seat 22 (FIG. 5) and the flange surface 35 seats against an inside flange 20 of the insulator housing 5.

Figure 7:
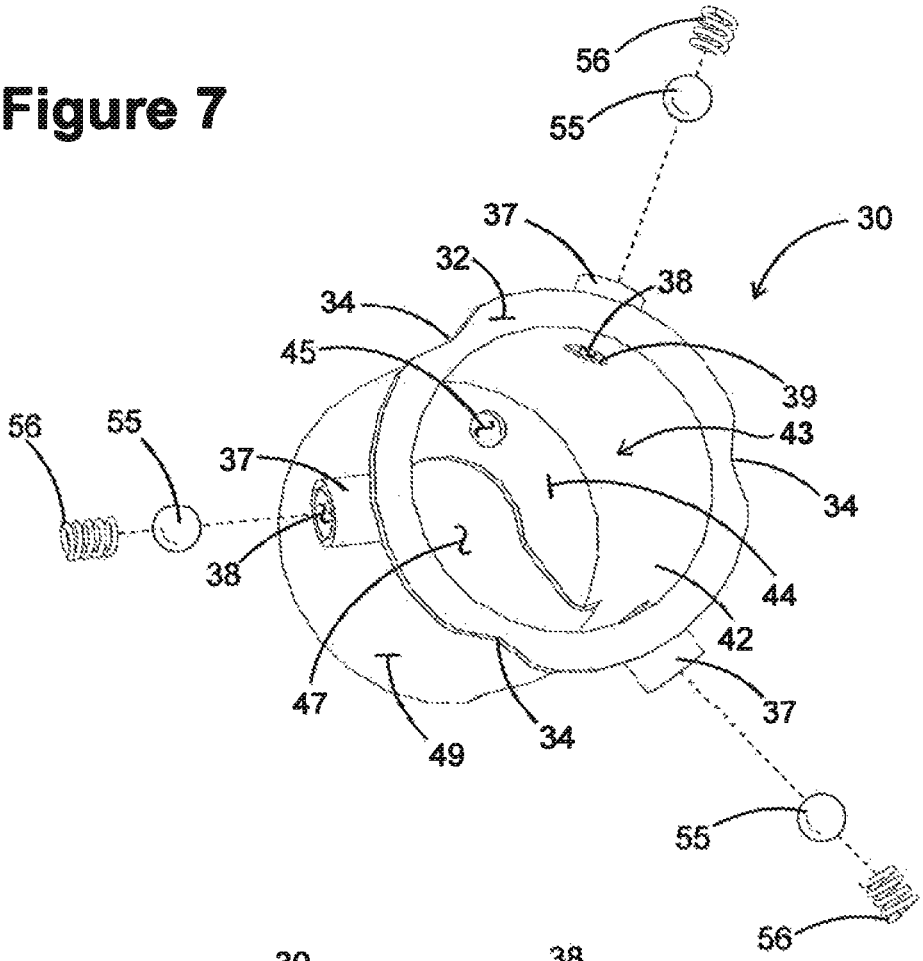
FIG. 7 is an exploded isometric top and side view of the ground socket assembly, showing the spring housings, the thread locks and the biasing springs.
Figure 8:
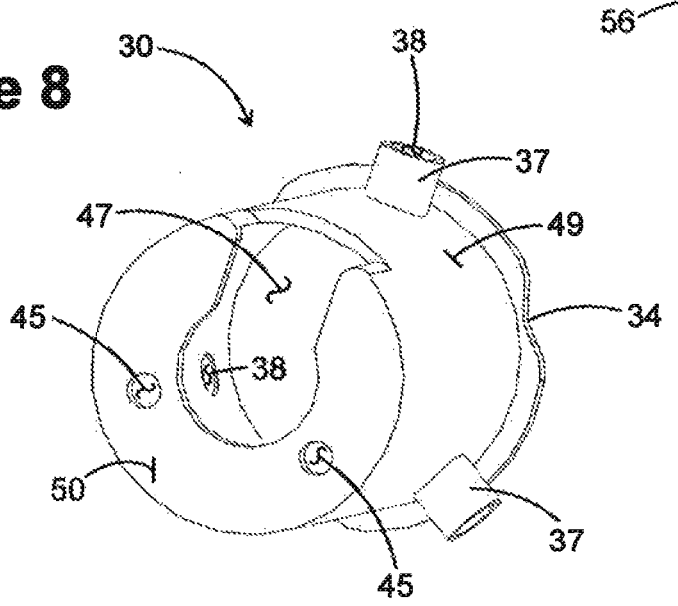
FIG. 8 is an isometric bottom and side view of the ground socket of FIG. 7.
Figure 10:
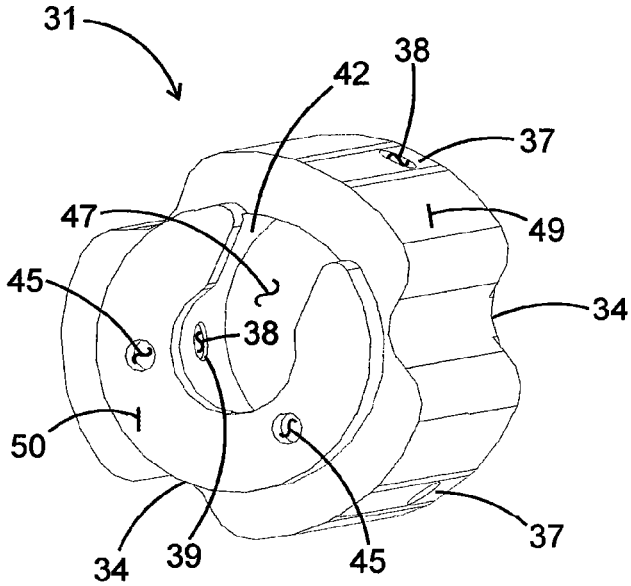
FIG. 10 is an isometric bottom and side view of the ground socket of FIG. 9

FIGS. 7 and 8 show the ground socket 30 formed from thin electrically conductive material, such as but not limited to, copper and which defines a medial chamber 43. FIGS. 9 and 10 show a second embodiment of the ground socket 31 that is cast or formed from thicker conductive material, such as, but not limited to, aluminum.

Ground sockets 30, 31 each carry plural spacedly arranged spring housings 37, each of which defines a medial channel 38 and a thread lock seat 39 at an end portion adjacent inside surface 42. Spring housings 37 are staggered in height relative to the top 6 and bottom 15 so the thread locks 55 align with thread grooves defined in light bulb base 2. Thread locks 55 are carried in the medial channel 38 defined by each thread lock housing 37 and protrude partially through thread lock seats 39 adjacent the inside surface 42 of the ground socket 30, 31, so that the thread locks 55 engage in the concave portions of threads of a light bulb base 2. The thread lock seats 39 defined in the inside surface 42 have a radius (not shown) that is slightly smaller than the radius (not shown) of thread lock 55 so that the thread locks 55 cannot pass therethrough. Biasing springs 56 apply inward radial pressure to the thread locks 55 to force the thread locks 55 frictionally against the thread lock seats 39. When a light bulb is pushed into the assembly 4, the biasing springs 56 allow the thread locks 55 to retract into the medial channels 38 defined by spring housings 37 as the threads of a light bulb base 2 slide past the thread locks 55 until the light bulb base 2 is secured within the ground socket 30. The biasing springs 56 bias the thread locks 55 into the deepest portions of the threads on the light bulb base 2 which responsively secure the light bulb and simultaneously maintain electrical contact with the ground sockets 30, 31.

Bottom mounting flange 44 (FIG. 9) of ground socket 30, 31 defines mounting holes 45 for securement of an insulator cap 68 (FIGS. 13, 14) that defines a socket mounting surface 72 for seating the ground socket 30, 31. Ground sockets 30, 31 also define a positive terminal cut out 47 (FIGS. 9, 10) that accommodates positive conductor mounting surface 74 (FIG. 13) in the insulator cap 68.

The ground socket 30, 31 has an outer circumferential surface 49 and is axially carried within a housing channel 28 defined by the insulator housing 5, 26. In the first embodiment (FIG. 8), bottom 50 of the ground socket 30, 31 mates with socket mounting surface 72 of the insulator cap 68. In the second embodiment (FIG. 10) outer circumferential surface 49 of ground socket 31 extends radially outwardly of the socket mounting surface 72 to an outside edge of the insulator cap 68. The first embodiment 30 and the second embodiment 31 of the ground socket 30, 31 fit axially into the channel 28 defined by the insulator housing 5, 26 and are able to use different insulator caps 68, 69 depending upon the type of light fixture into which the assembly 4 is being installed.

Figure 13:
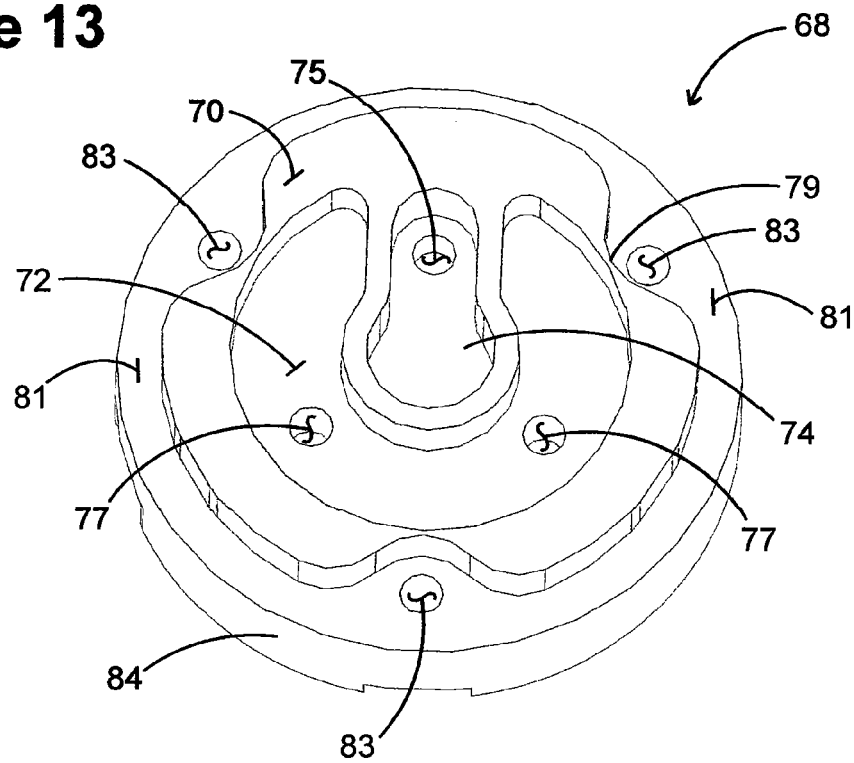
FIG. 13 is an isometric top and side view of the insulator cap.
Figure 14:
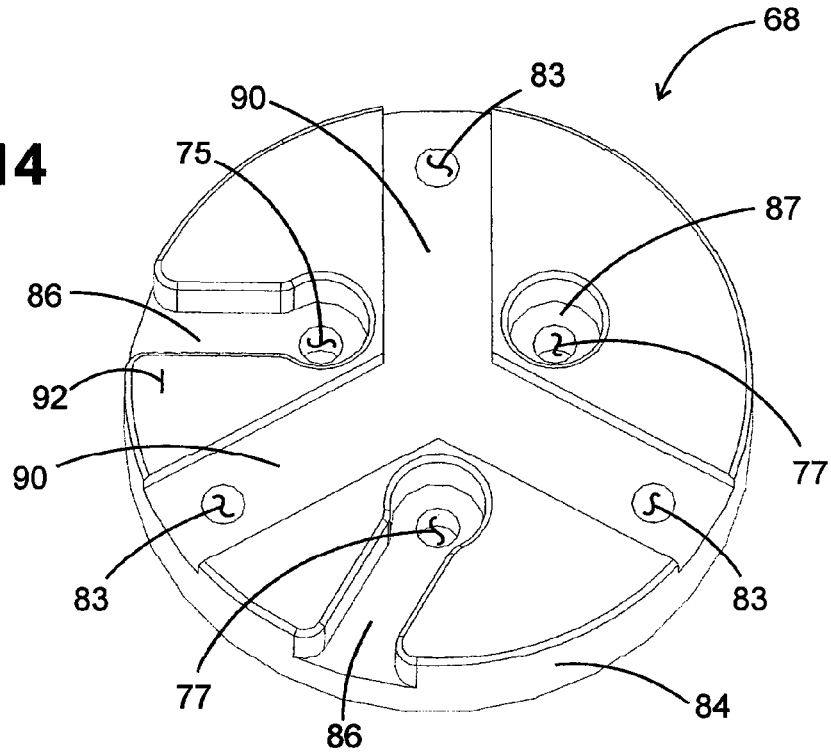
FIG. 14 is an isometric bottom and side view of the insulator cap of FIG. 13.
Figure 15:
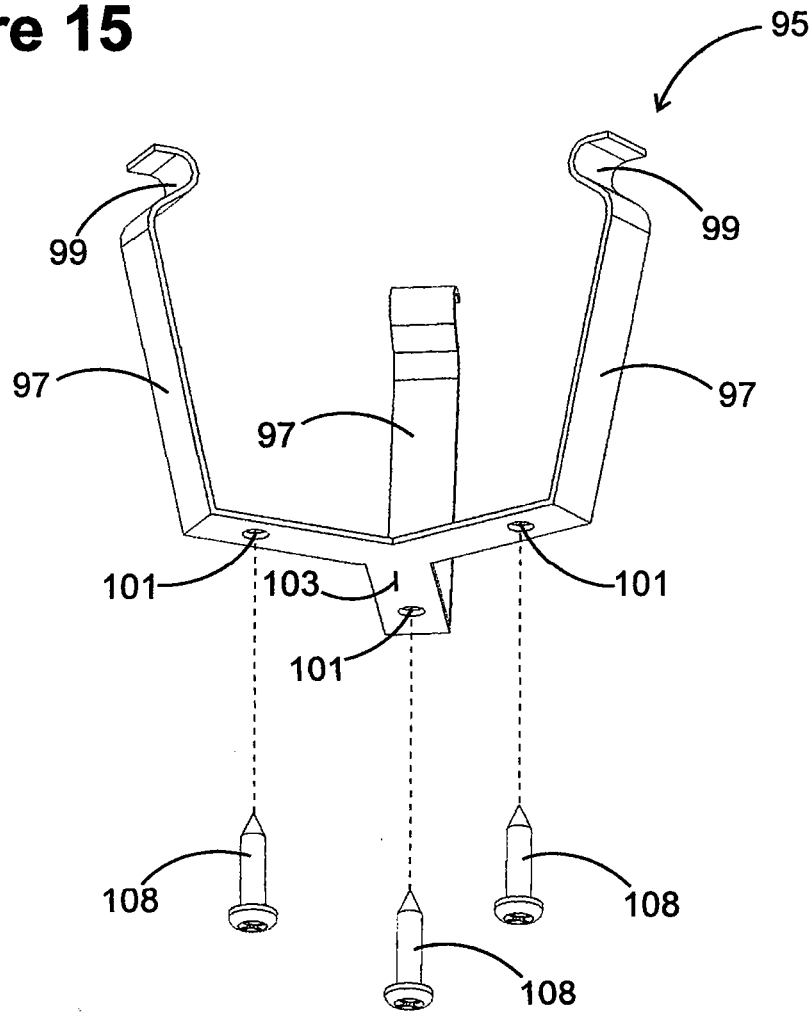
FIG. 15 is an isometric bottom and side view of the socket retainer and fasteners.

FIGS. 13 and 14 show the insulator cap 68 defining a positive contact mounting hole 75 and plural spacedly arranged ground socket mounting holes 77 which align with mounting holes 45 defined in the ground socket 30, 31. Insulator cap mounting holes 83 are also defined in the insulator cap 68 which align with mounting holes 16 defined in the bottom 15 of the insulator housing 5, 26. Alignment reliefs 79 align with bosses 24 in the insulator housing 5, 26.

Figure 16:
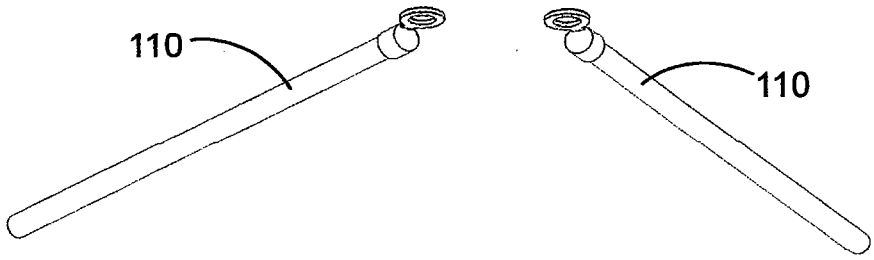
FIG. 16 is an isometric bottom and side view of power supply wire leads.

Mounting surface 81 of insulator cap 68 seats against the bottom 15 of the insulator housing 5, 26 and outer circumferential surface 12 of the insulator housing 5, 26 aligns with outer circumferential surface 84 of the insulator cap 68, enclosing the ground socket 30, 31 within the insulator housing 5 and forming an aesthetically appealing assembly 4. FIG. 14 shows bottom 92 of the insulator cap 68 and wire mounting locations 86 which carry positive and negative wire leads 110. (FIG. 16). Counter-sunk fastener seat 87 carries a ground socket fastener 106. Socket retainer mounting recess 90 is defined in bottom 92, so when the socket retainer 95 is fastened to the insulator cap 68, the socket retainer 95 is flush with the bottom 92 of the insulator cap 68, allowing additional bottom clearance and creating an aesthetically appealing appearance.

Figure 11:
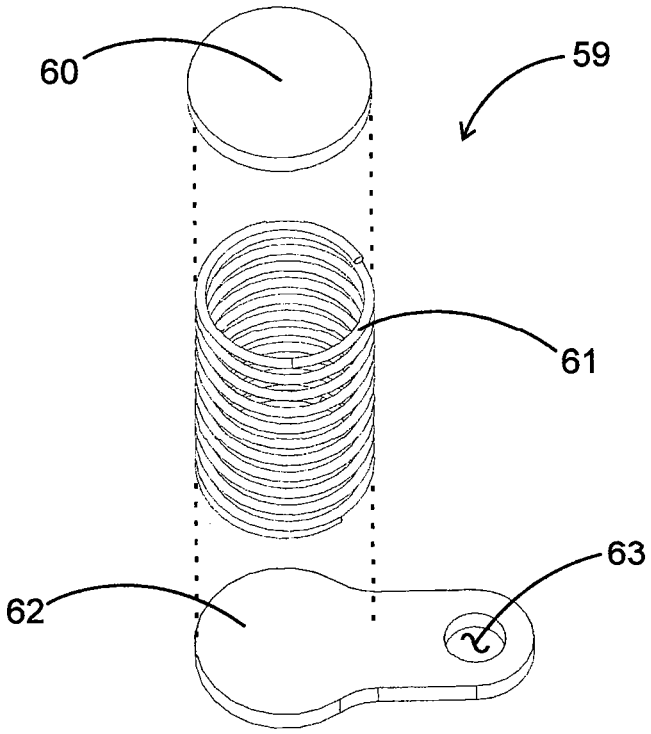
FIG. 11 is an isometric top and side view of the positive contact assembly
Figure 12:
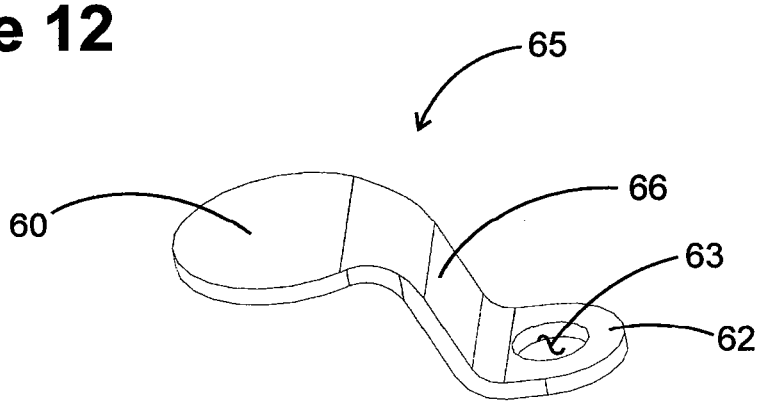
FIG. 12 is an isometric top and side view of a second embodiment of the positive contact assembly.

FIGS. 11 and 12 show first and second embodiments of positive contact assemblies 59, 65 which have a positive contact 60 to conduct electrical energy to a light bulb within the assembly 4. The positive contact 60 communicates with a positive contact spring 61 which communicates with positive contact mounting flange 62. The components of the positive contact assembly 59, 65 are constructed from an electrically conductive material such as, but not limited to, copper. The contact spring 61 applies upwardly biasing force to the contact 60 so that electrical contact with a positive terminal of a light bulb is achieved and maintained. The positive contact mounting flange 62 defines a mounting hole 63 for a fastener 106 to positionally secure the positive contact mounting flange 62 in electrical contact with mounting surface 74 in the insulator cap 68, 69.

FIG. 12 shows a second embodiment of the positive contact assembly 65 which is similarly formed of electrically conductive material such as, but not limited to, copper and has a contact 60, a spring steel arm 66 that flexes to provide continuous contact with a light bulb positive terminal and a contact mounting flange 62 defining a mounting hole 63 for a fastener 106. Both embodiments 59, 65 of the positive contacts 59, 65 fit against the contact mounting surface 74 in the insulator caps 68, 69.

Assembly of my threadless light socket assembly 4 begins with the positive terminal contact 59, 65, the insulator cap 68, a fastener 106, and the positive wire lead 110. One takes the insulator cap 68 and installs the positive terminal contact 59, 65 onto the contact mounting surface 74. The positive wire lead 110 is attached to the positive wire mounting location 86 with fastener 106, extending through a known electrical fitting carried by the positive wire lead 110 through the positive conductor mounting hole 75 and into the mounting hole 63 defined in the positive terminal contact 59, 65. The ground socket 30, 31 is then installed onto the ground mounting surface 72 of the insulator cap 68, 69 by attaching the ground wire lead 110 into the ground wire mounting location 86 with a fastener 106 extending through a known electrical fitting on the ground wire lead 110 into the ground socket mounting hole 77 and into the mounting hole 45 defined in the ground socket 30, 31. A fastener 106 is also placed in the fastener seat 87 to extend into and through the mounting hole 77 and into the mounting hole 45 defined in the ground socket 30 or 31. The assembled insulator cap 68 assembly is then installed into the channel 28 of the insulator housing 5. When the assembled ground socket 30, 31 is installed on the insulator cap 68, 69 alignment relief 79 will align with the alignment relief 34 of the ground socket 30, 31. The alignment of the reliefs 34, 79 insures the components fit together correctly.

After aligning the assembled ground socket 30, 31 assembly with the bottom 15 of the insulator housing 5, the ground socket 30, 31 is inserted axially into the channel 28 of the insulation housing 5 only far enough so the spring housings 37 remain outside the insulator housing 5. A thread lock 55 first and then a biasing spring 56 are inserted into the channel 38 of each spring housing 37. After a thread lock 55 and a biasing spring 56 is inserted into each spring housing 37 channel 38 and the biasing springs 56 are compressed flush to outside edge of the spring housing 37, the ground socket 30, 31 is "pushed" the "rest of the way" into the channel 28 defined by the insulator housing 5. Beveled edge 17 helps the biasing springs 56 slide onto the spring seat 18. The top 32 of the ground socket 30, 31 will seat frictionally against the inside seat 22 in the insulator housing 5. Mounting surface 81 of the insulator cap 68 seats frictionally against the bottom 15 of the insulator housing 5.

To fasten the insulator cap 68 to the insulator housing 5, first install the socket retainer 95 with the spring arms 97 and the retainer locks 99 going around the insulator housing 5. The retainer locks 99 align with the retainer reliefs 10. The socket retainer 95 fits into the retainer mounting recess 90 so the bottom 103 seats flush to the bottom 92 of the insulator cap 68. Fasteners 108 extend through the mounting holes 101 in the socket retainer 95 through the insulator cap mounting holes 83 and into the insulator housing 5. The completed assembly 4 may now be installed into a recessed lighting fixture (not shown). The assembly 4 clips into a recessed light fixture (not shown) by compressing the spring arms 97 together radially toward the insulator housing 5 so that the retainer locks 99 snap into the spring retainer reliefs 10, the assembly 4 is installed into a light fixture socket hole (not shown) and the spring arms 97 thereafter flex back outwardly, securing the threadless light socket assembly 4 into the recessed light fixture (not shown).

Figure 17:
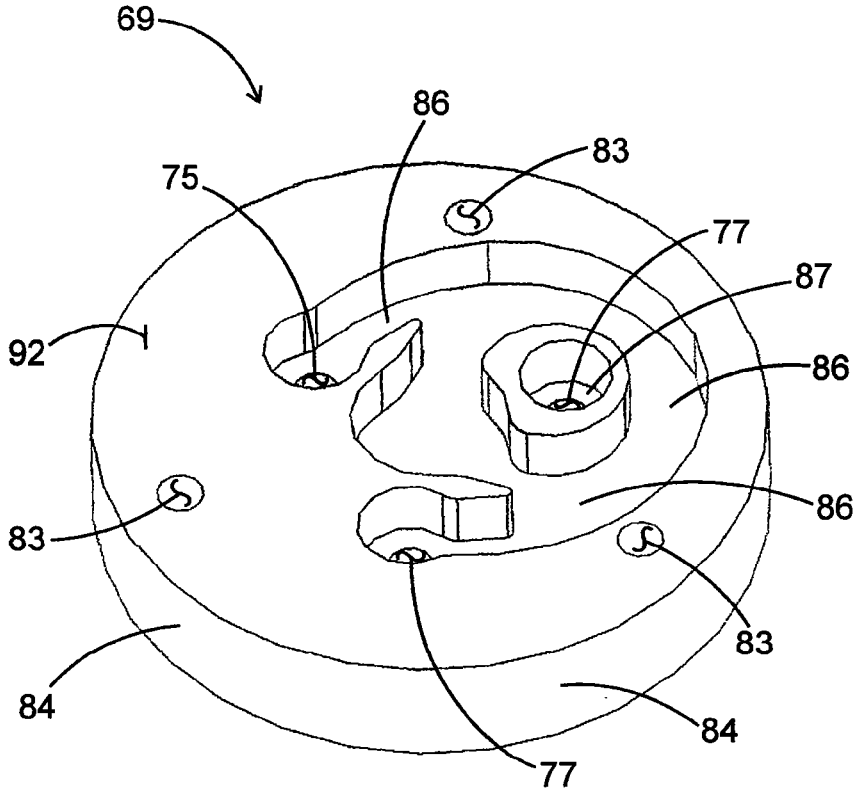
FIG. 17 is an isometric bottom and side view of a second embodiment of the insulator cap.
Figure 18:
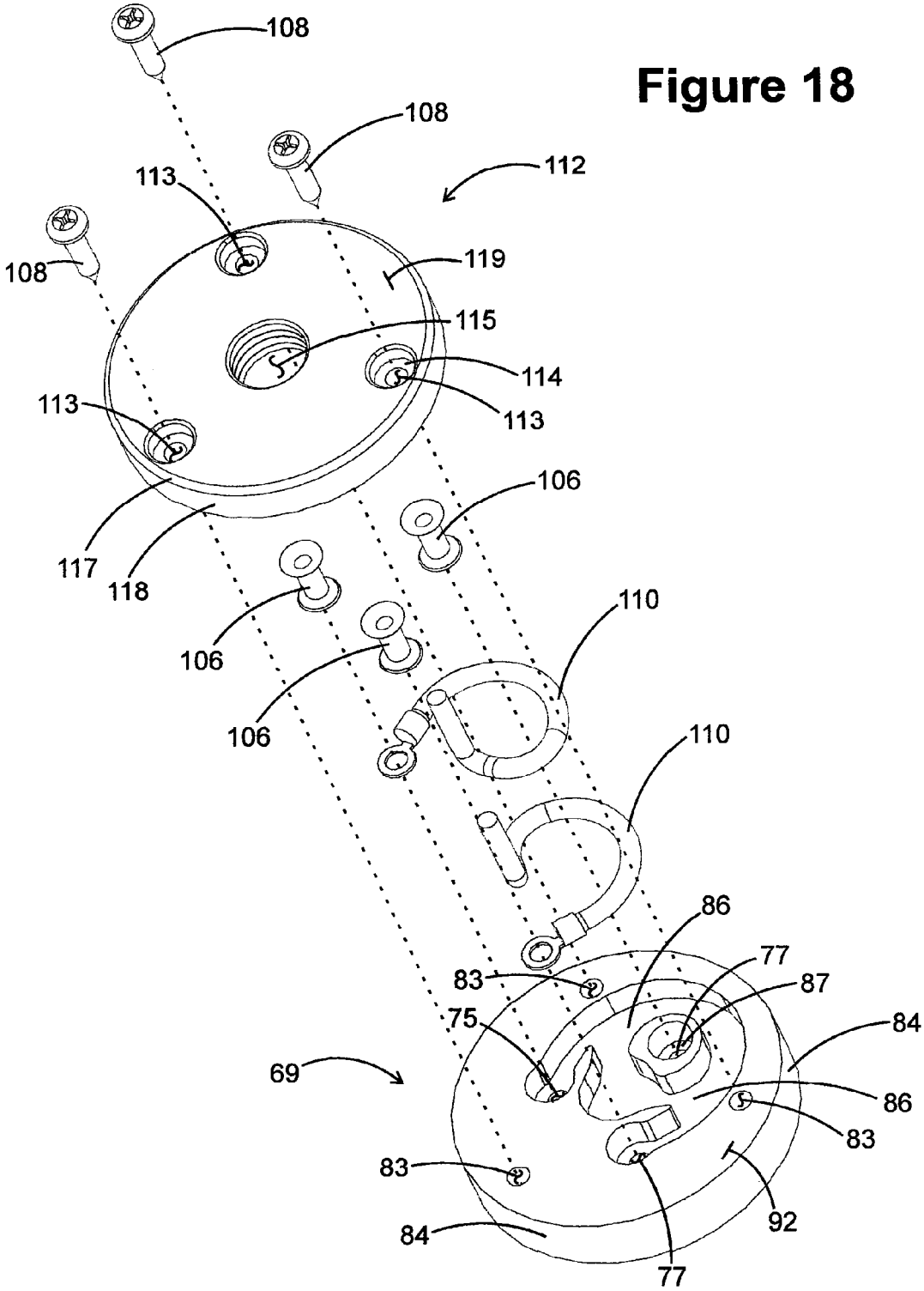
FIG. 18 is an exploded isometric bottom and side view of the second embodiment of the insulator cap with a lamp style bottom cap.

Other light fixtures (not shown) are designed for light socket assemblies to be mounted in a vertical position. For such fixtures, my second embodiment of the insulator housing 26 is used. My second embodiment 26 has an outside beveled edge 27 to provide an improved aesthetic appearance but all the components of the first and second embodiments 5, 26 respectively are interchangeable. FIG. 17 shows the second embodiment of the insulator cap 69 which has the same top 70 as insulator cap 68. The bottom 92 channels the positive and negative wire leads 110 to wire mounting locations 86 around a fastener seat 87 toward a center portion where the wire leads 110 pass through center mounting hole 115 of lamp style bottom cap 112. (FIG. 18). Bottom cap 112 fastens to the bottom 92 of the insulator cap 69 with fasteners 108 that extend through bottom cap mounting holes 113 and seat against fastener seats 114 through the insulator cap 69 mounting holes 83 and into the insulator housing mounting holes 16 defined in the insulator housing 26. Bottom cap 112 also has a beveled edge 117 around the outside of the bottom 119. Outer circumferential surface 118 of bottom cap 112 aligns with the outer circumferential surface 84 of the insulator cap 69. A threaded mounting hole 115 is defined in a center portion of the bottom cap 112 though which the wire leads 110 pass making it possible to install my threadless light socket assembly 4 onto a threaded light fixture tube (not shown) and have the wire leads 110 pass through the tube (not shown).

Figure 6:
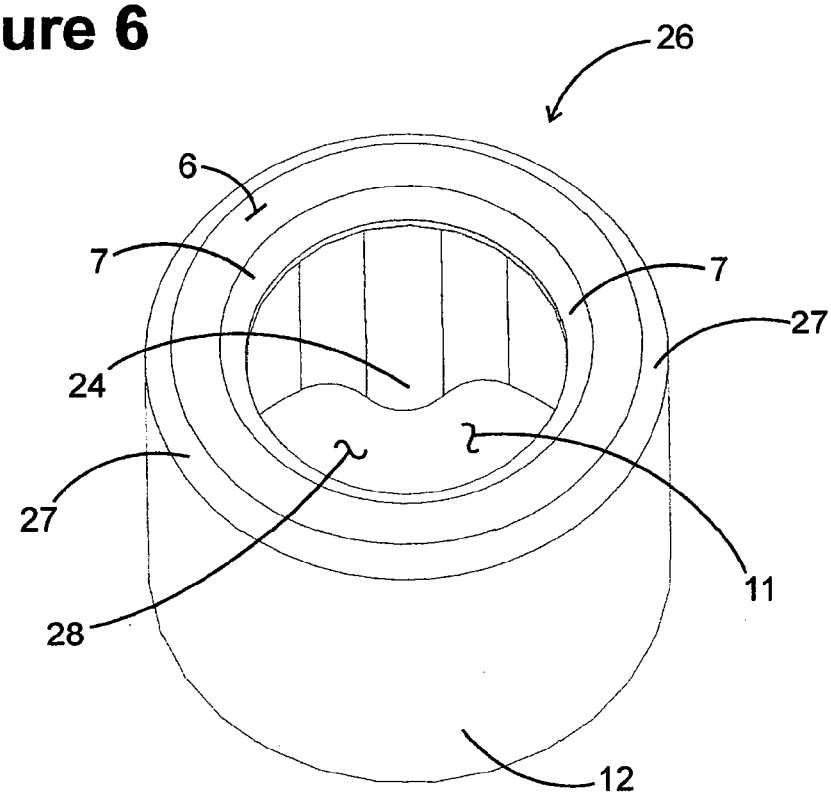
FIG. 6 is an isometric top and side view of a second embodiment of the insulator housing.
Figure 19:
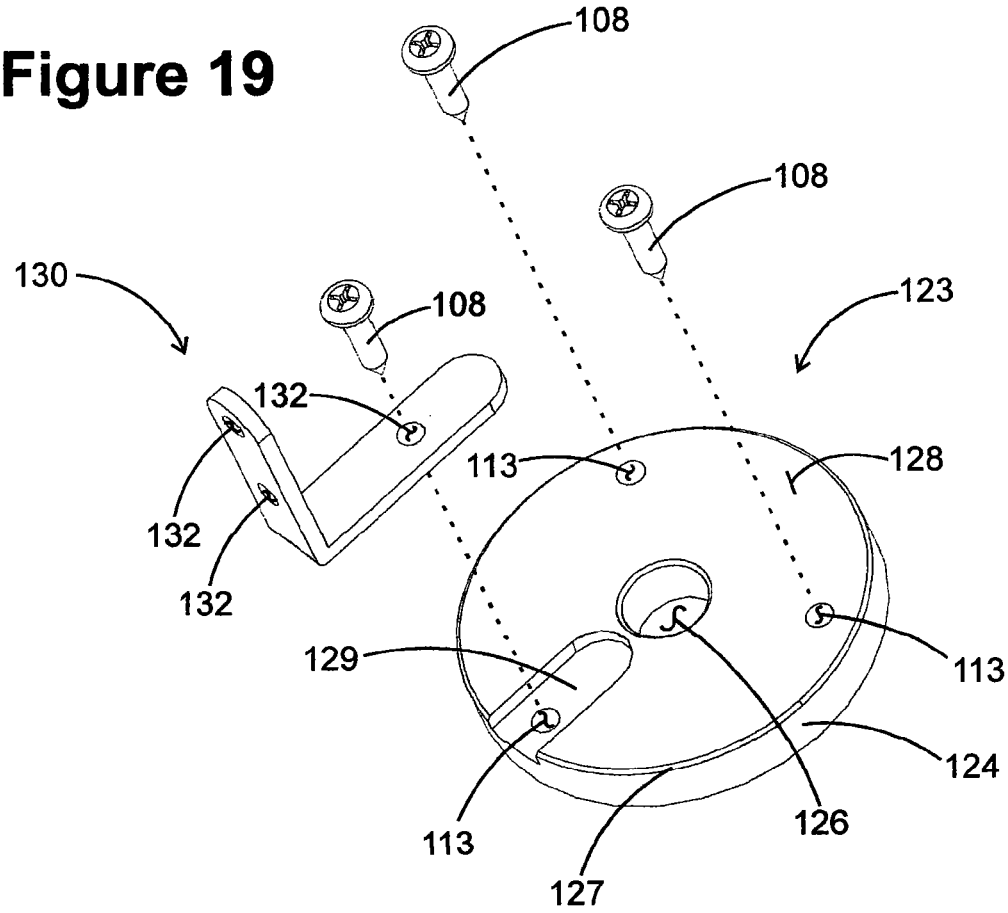
FIG. 19 is an isometric bottom and side view of a second embodiment of a bottom cap with a 90 degree connection bracket.
Figure 20:
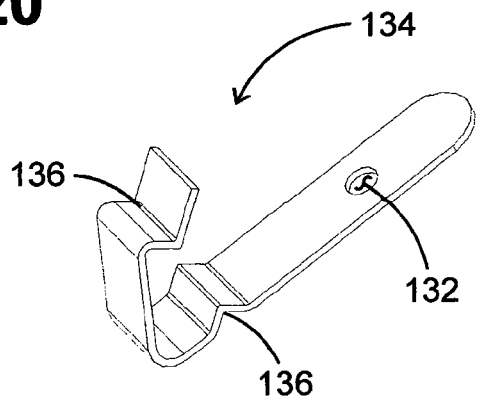
FIG. 20 is an isometric bottom and side view of a spring type 90 degree connection bracket.

Other light fixtures (not shown) are designed for the light socket assemblies to be mounted in the horizontal orientation (not shown). For such horizontal mounting light fixtures, my threadless light socket assembly 4 may use the lamp style insulator housing 26 (FIG. 6), and bottom cap 123 shown in FIG. 19. Bottom cap 123 has a hole 126 defined in a center portion and defines a bracket relief 129 for a 90 degree mounting bracket 130. The bracket relief 129 is a recess defined in the bottom 128 of the bottom cap 123 so when the 90 degree mounting bracket 130 is installed thereon the mounting bracket 130 is flush with the bottom 128. Beveled edge 127 extends about the bottom 128 outer circumferential surface 124 and the outer circumferential surface 124 is the same size as the outer circumferential surface 84 of the insulator cap 69 so that the two pieces align with an aesthetically appealing seam. The 90 degree mounting bracket 130 defines mounting holes 132 to mount the threadless light socket assembly 4 to the fixture (not shown). FIG. 20 shows a spring type 90 degree mounting bracket 134 that may be used in light fixtures that define a rectangular "cut out" that retainer locks 136 clip into and hold the assembly 4 horizontal in the light fixture (not shown).

My threadless light socket assembly 4 and all its interchangeable components can be adapted for use with various light fixtures in use or on the market today.

The above description of my invention has set out various features, functions, methods and other aspects of the invention. This has been done with regard to the currently preferred embodiments thereof. Time and further development may change the manner in which the various aspects are implemented. Such aspects may further be added to by the language of the claims which are incorporated by reference hereinto as originally filed. The scope of protection accorded the invention, as defined by the claims, is not intended to be necessarily limited to the specific sizes, shapes, features or other aspects of the currently preferred embodiment shown and described. The claimed invention may be implemented or embodied in other forms still being within the concepts shown, described and claimed herein. Also included are equivalents of the invention which can be made without departing from the scope or concepts properly protected hereby.

The foregoing description of my invention is necessarily of a detailed nature so that a specific embodiment of a best mode may be set forth as is required, but it is to be understood that various modifications of details, sizes, and rearrangement, substitution and multiplication of the parts may be resorted to without departing from its spirit, essence or scope.

Having thusly described my invention, what I desire to protect by Utility Letters Patent and

What I claim is:

1. A threadless light bulb socket for releasable non-rotational engagement with a threaded base of a light bulb comprising:

an insulator housing of electrically insulative material having a top portion defining an opening, a bottom portion, an outer circumferential surface and defining a housing channel communicating between the top portion and the bottom portion;

an electrically conductive ground socket carried within the housing channel of the insulator housing and defining a medial chamber communicating with the opening defined in the insulator housing and having an outer circumferential surface, an inner circumferential surface, and communicating with a ground lead wire;

a ground socket spring housing having an outer end proximate the outer circumferential surface of the ground socket, a thread lock seat proximate the inner circumferential surface of the ground socket and defining a medial channel communicating between the outer end and the thread lock seat;

a thread lock and a biasing spring carried in the medial channel of the spring housing to bias the thread lock toward the thread lock seat and partially into the medial chamber of the ground socket to communicate with an electric terminal of the threaded base of the light bulb; and a cap fastened to the bottom portion of the insulator housing to enclose the ground socket within the medial chamber, the cap carrying a positive terminal contact to electrically communicate with the threaded base of the light bulb and a positive lead wire.

2. The threadless light bulb socket of claim 1 wherein a plurality of the spring housings are defined spacedly arrayed in the ground socket and extend between the outer circumferential surface of the ground socket and the inner circumferential surface of the ground socket.

3. The threadless light bulb socket of claim 1 wherein:

the thread lock is an electrically conductive sphere.

4. The threadless light bulb socket of claim 1 wherein:

the ground socket slides axially into the housing channel defined by the insulator housing.

5. The threadless light bulb socket of claim 1 wherein:

the biasing spring may be removed and replaced with another biasing spring to one of increase and decrease radial pressure exerted on the thread lock and the threaded base of the light bulb.

6. The threadless light bulb socket of claim 1 wherein the ground socket comprises a plurality of the spring housings which are structurally secured to the outer circumferential surface of the ground socket in a spaced array.

7. The threadless light bulb socket of claim 1 wherein the ground socket comprises a plurality of the spring housings which are defined in the outer circumferential surface of the ground socket in a spaced array and communicate between the outer circumferential surface of the ground socket and the inner circumferential surface of the ground socket.

8. The threadless light bulb socket of claim 1 wherein:

the cap is configured to provide attachment of the threadless light bulb socket to a light fixture.

9. The threadless light bulb socket of claim 1 wherein:

an inner circumferential surface of the insulator housing defines a biasing spring seat that frictionally communicates with the outer end of the spring housing and retains the thread lock and biasing spring within the medial channel of the spring housing.

10. The threadless light bulb socket of claim 1 further comprising:

a releasable mount carried on the cap to mount the threadless light bulb socket to a light fixture.

11. The threadless light bulb socket of claim 1 further comprising:

a mount carried on the cap to mount the threadless light bulb socket to an adjacent surface.

12. The threadless light bulb socket of claim 1 wherein:

insertion of the threaded base of the light bulb through the opening defined in the insulator housing and into the medial chamber of the ground socket overcomes the biasing of the thread lock by the biasing spring causing the thread lock to move radially away from the thread lock seat and into the medial channel defined by the spring housing.

13. The threadless light bulb socket of claim 1 wherein:

the biasing spring exerts radial inward pressure on the thread lock forcing the thread lock into a concave depression formed in the threaded base of the light bulb carried within the medial chamber of the ground socket.

14. The threadless light bulb socket of claim 1 wherein:

a plurality of the spring housings are spacedly arrayed radially about the ground socket and spacedly arrayed vertically about the ground socket.

* * * * *